United States Patent [19]

Lamb

[11] 4,198,710

[45] Apr. 22, 1980

[54] FASTENER FOR HELMET SUSPENSION

[76] Inventor: Charles C. T. Lamb, 33 Walker Rd., Willowdale, Ontario, Canada, M2N 2K2

[21] Appl. No.: 949,651

[22] Filed: Oct. 10, 1978

[30] Foreign Application Priority Data

Oct. 11, 1977 [CA] Canada ..... 288421

[51] Int. Cl.[2] ..... A42B 3/00

[52] U.S. Cl. ..... 2/416

[58] Field of Search ..... 2/416, 417; 24/204, 24/208 A

[56] References Cited

U.S. PATENT DOCUMENTS

| | | | |
|---|---|---|---|
| 3,422,459 | 1/1969 | Bowers | 2/416 |
| 3,878,562 | 4/1975 | Lamb | 2/416 |
| 3,950,788 | 4/1976 | Lamb | 2/417 |
| 4,106,127 | 8/1978 | Marangoni et al. | 2/416 |

FOREIGN PATENT DOCUMENTS

| | | | |
|---|---|---|---|
| 1279295 | 6/1972 | United Kingdom | 2/416 |

*Primary Examiner*—Louis Rimrodt
*Attorney, Agent, or Firm*—James T. Wilbur

[57] ABSTRACT

The fastener is formed within a protective helmet provided with a crown suspension and a head suspension. The crown suspension has a central portion adapted to contact the top of a wearer's head and has radially outwardly extending legs. The head suspension includes an outer strap which encircles the wearer's head at approximately the level with respect to the wearer's head of a normal hat band. A barb is joined to the end of each leg and tapers in thickness from its juncture with the leg to its end. A barb is also joined to a portion of the strap at its upper edge and likewise tapers in thickness from its juncture with the strap to its end. A number of flaps are connected to the inside wall of the helmet. Each flap has a slot through which the leg and strap extend, and above which the barbs connected to the straps are positioned. The barbs connected to the legs are accommodated in the space between the flaps and the inside wall of the helmet. The slots have a width less than the sum of the thicknesses of the barb adjacent thereto at their junctures with the leg and strap respectively, whereby removal of the barbs through the slots is prevented.

6 Claims, 4 Drawing Figures

FASTENER FOR HELMET SUSPENSION

BACKGROUND OF THE INVENTION

This invention relates to protective helmets and more particularly to novel means for attachment of a suspension means or liner within a protective helmet.

Suspensions or liners for use with protective helmets usually are composed of two basic parts. One part is generally referred to as the "head suspension" and extends horizontally around the wearer's head at approximately the level of an oridnary hat band. The head suspension serves principallly to cushion generally horizontally directed blows on the outer shell of the helmet. The other part is generally referred to as the "crown suspension" and extends over the top of the wearer's head. The latter suspension serves to cushion blows directed generally downwardly against the shell.

Crown and head suspensions are conventionally attached to the inside wall of the shell of the helmet by means of metallic rivets. For a number of reasons however rivets are an unsatisfactory attachment means. First should the suspension not maintain the wearer's head in spaced relationship with the shell when the later is struck by a blow, the head may be struck by the rivet and injured. Secondly rivets must either be installed by hand or by relatively complicated machinery and are, therefore, an expensive means for maintaining the suspension in position. Thirdly rivets must usually be installed by skilled workmen and hence, in practice, will usually be installed at the factory where the helmet shell and suspension are manufactured. Since rivets cannot be installed at the retail outlet where the helmet is sold, the retailer cannot be provided with suspensions which fit various sized heads so that the retailer can himself install a suspension of the size required to fit a particular customer's head. The retailer must, therefore, maintain a large stock of helmet shells to fit a range of head sizes.

SUMMARY OF THE INVENTION

It is an object of the present invention to provide means which serves to attach a crown and head suspension to a helmet shell and which may optionally be formed of non-metallic or other relatively soft material to avoid injuring the head should the head strike it.

Another object of the invention is to provide an attachment means to which a crown and head suspension may be easily connected without special tools whereby the suspension may be attached at a retail outlet where protective helmets are sold.

A further object is to provide an attachment means which may be molded to the inside of the wall of the shell simultaneously with the molding of the shell. A collapsible mold is not required in the formation of the shell and attachment means.

These and other objects may be accomplished by attachment means useful for attaching a crown suspension or a head suspension or both a crown and head suspension to the shell of a helmet. The means for attaching a crown suspension to a helmet shell includes a barb which is joined to at least one leg of a crown suspension and which tapers in thickness from its juncture with the leg to its end; and a suspension engaging member formed on the inside wall of the helmet within which said barb is accommodated, said member having a slot through which said leg extends and which has a width less than the thickness of the barb at said juncture whereby removal of the barb through said slot is prevented. The means for attaching a head suspension to the shell of a helmet includes a barb joined to the head encircling strap of the suspension at its upper edge and which tapers in thickness from its juncture with the strap to its end; and a suspension engaging member formed on the inside wall of the helmet within which said strap portion is accommodated, said member having a slot through which said strap extends and above which said barb is positioned, said slot having a width less than the thickness of the barb at said juncture whereby removal of the barb through said slot is prevented.

DESCRIPTION OF THE DRAWINGS

The invention will be more fully explained with reference to the accompanying drawings which show a preferred embodiment of the attachment means. In the drawings.

Like reference characters refer to like parts throughout the description of the drawings.

DESCRIPTION OF THE PREFERRRED EMBODIMENT

Figure 1:
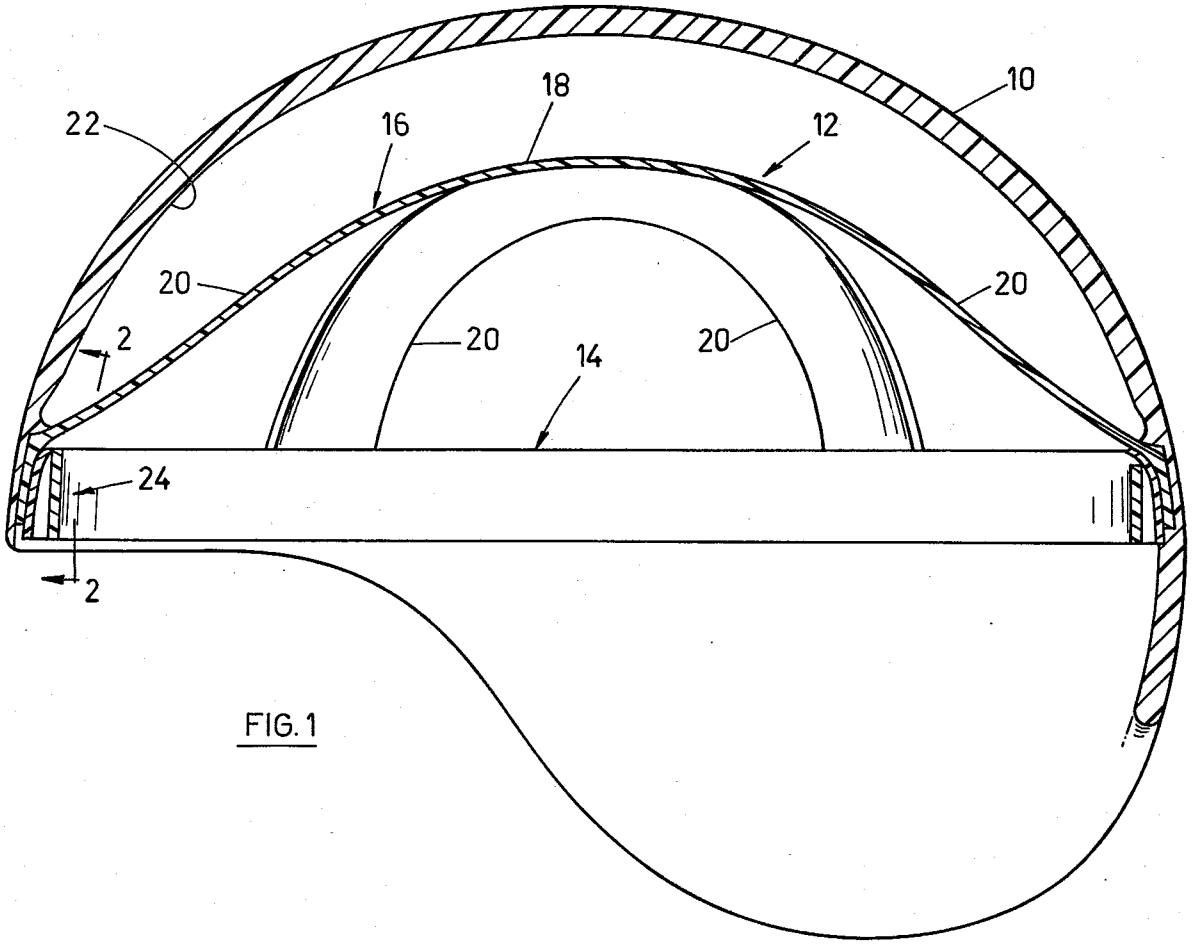
FIG. 1 is an elevation, partly in section, of the attachment means of the invention shown in conjunction with a head and crown suspension and a shell.

Referring to FIG. 1, the helmet is of conventional design, having a semi-rigid resinous shell 10, and a suspension means generally 12 to position the shell on a wearer's head in such fashion that it is maintained in spaced relationship to the head to absorb the shock of blows imparted to the external surface of the shell.

The suspension means is composed of a head suspension, generally 14, and a crown suspension, generally 16. The components of both suspensions are composed of tough inelastic fabric or polymeric materials such as polyethylene or rubber. Head and crown suspensions of various constructions are known and are the subject matter of a number of patents including my U.S. Pat. Nos. 3,950,788 and 3,878,562. To facilitate an understanding of the subject attachment means it will be described in conjunction with the head and crown suspension described in these patents. As the description proceeds however it will be obvious that the attachment means may be used in conjunction with head and crown suspensions of other constructions and it is in fact intended that it be so used.

The crown suspension includes a central portion 18 which is adapted to contact the top of a wearer's head. A number of legs 20 extend radially outwardly from the central portion and each leg is attached to the inside wall 22 of the shell by a separate attachment means generally 24. The attachment means are located about the inside wall so that each is positioned adjacent a separate leg when the crown suspension is disposed for use in the shell as illustrated.

Figure 3:
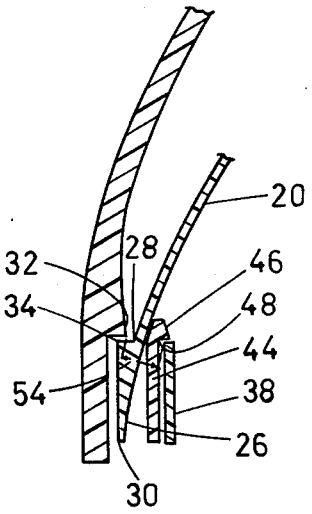
FIG. 3 is a section on line 3—3 of FIG. 2.
Figure 4:
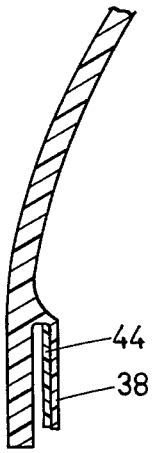
FIG. 4 is a section on line 4—4 of FIG. 2.
Figure 2:
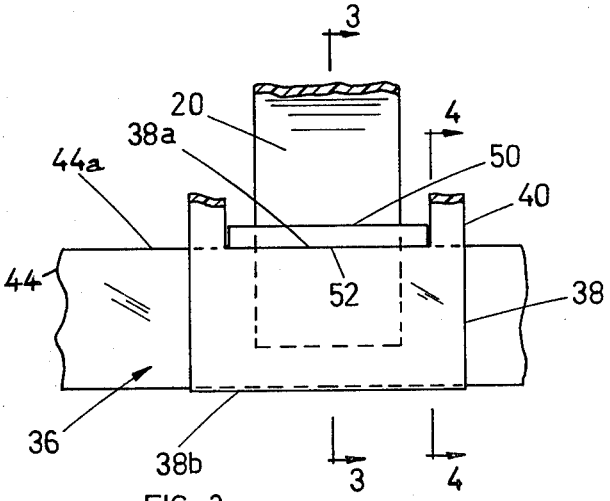
FIG. 2 is an enlarged elevation on line 2—2 of FIG. 1.

With reference to FIG. 3, a barb 26 is formed on the lower end of each leg 20. The barb tapers in thickness from its juncture 28 with the leg to its lower end 30. A protuberance 32 is formed on the inside wall of the shell and it contacts the upper wall 34 of the barb.

The barb is accommodated in a suspension engaging member, generally 36 which comprises a flap 38 and a pair of spaced apart tabs 40 having lower ends integrally connected to the flap and upper ends connected to the inside wall of the shell. The upper edge 38*a* of the flap between the two tabs defines one side of a slot and the other side is defined by the outer end of protuberance 32. Leg 20 passes through the slot and is prevented from being removed therefrom by barb 26.

The head suspension includes a continuous horizontal headencircling strap 44 having an upper edge 44*a* provided with a barb 46, which likewise tapers in thickness from its juncture 48 with the strap to its upper edge 50. The length of the barb is somewhat less than the distance between tabs 40 so that the entire length of the lower edge of the barb will rest against the upper edge 38*a* of the flap. So that strap 44 can be positioned between the flap and the inside wall of the shell as illustrated, the two side edges of the flap are open i.e. are not connected to the inside shell wall. Likewise the flap is open along its lower edge 38*b* so that the strap can be raised to the illustrated position in the manner described below.

The width of the slot, indicated 54 in FIG. 3, is less than the thicknesses of barbs 26 and 46 and their junctures with leg 20 and strap 44 respectively. As a result once the barbs are in the position illustrated in FIG. 3 they cannot be moved through the slot.

Preferably flap 38 is composed of sitff but somewhat resilient material so that it will deform sufficiently adjacent the slot to permit barb 26 to be inserted downwardly therethrough, and to likewise permit barb 46 to be inserted upwardly therethrough. The material must not, of course, be so flexible that it will deform sufficiently to permit withdrawal of the barbs through the slot.

Attachment of the barbs of the leg and strap to the suspension engaging member is easily accomplished. The crown suspension is positioned as illustrated in FIG. 1 and the barb of each leg is inserted through a slot of a suspension engaging member formed on the inside wall of the shell adjacent the barb. The strap of the head suspension is then forced upwardly to cause its barbs 46 to pass through the space between flap 38 and barb 26 in each suspension engaging member and through the slot. When the crown and head suspension are so positioned they cannot be removed from the shell short of breaking them or the suspension engaging members.

The suspension engaging members may be formed of polymeric material and molded to the inside of the wall of the shell simultaneously with the molding of the shell. A collapsible mold is not required in the injection molding of the shell and suspension engaging member. Suitable polymeric material includes lexon, thordon and polycarbonate.

It will be understood, of course, that modification can be made in the embodiment described and illustrated herein without departing from the scope and purview of the appended claims. For example the suspension engaging member may be used to connect only a crown suspension or only a head suspension to the shell of a helmet, but not both. When the member is used to connect only a crown suspension to a shell the width of slot 42 should be less than the thickness of barb 26 at its juncture 28 with leg 20. Likewise where the suspension engaging member is used to connect the strap of a head suspension to a shell the width of slot 42 should be less than the thickness of barb 46 at its juncture 48 with the strap.

What I claim as new and desire to protect by Letters Patent of the United States is:

1. In a protective helmet having an inside wall within which is disposed a crown suspension having a central portion adapted to contact the top of a wearer's head, and having radially outwardly extending legs, means for attaching at least one of said legs to the inside wall comprising: a barb which is joined to said leg and which tapers in thickness from its juncture with the leg to its end; and a suspension engaging member formed on the inside wall of the helmet within which said barb is accommodated, said member having a slot through which said leg extends and which has a width less than the thickness of the barb at said juncture whereby removal of the barb through said slot is prevented.

2. The protective helmet as claimed in claim 1 wherein said suspension engaging member is formed of resilient material which deforms sufficiently adjacent the slot to permit insertion of the barb therethrough but insufficiently to permit withdrawal of the barb therefrom.

3. The protective helmet as claimed in claim 1 wherein said suspension engaging member comprises a flap which is connected to the inside wall of the helmet by a pair of tabs and which, together with the area of the inside wall which faces said flap, define a space for accommodation of said barb, said helmet further including a protuberance disposed between said tabs and extending outwardly from the inside wall of the helmet, said protuberance having a lower surface which contacts a surface of said barb adjacent the juncture and further having an outer edge which, together with side edges of said tabs which face each other, define said slot.

4. In a protective helmet having an inside wall within which is disposed a head suspension including an outer strap which encirlces the wearer's head at approximately the level with respect to the wearer's head of a normal hat band, means for attaching at least a portion of said strap to the inside wall comprising: a barb which is joined to said strap portion at its upper edge and which tapers in thickness from its juncture with the strap to its end; and a suspension engaging member formed on the inside wall of the helmet within which said strap portion is accommodated, said member having a slot through which said strap extends and above which said barb is positioned, said slot having a width less than the thickness of the barb at said juncture whereby removal of the barb through said slot is prevented.

5. The protective helmet as claimed in claim 4 wherein said suspension engaging member comprises a flap which is connected to the inside wall of said helmet by a pair of tabs and which, together with the area of the inside wall which faces the said flap, define a space for accommodation of said strap portion, said flap having an upper edge which, together with side edges of said tabs which face each other, define said slot.

6. In a protective helmet having an inside wall within which is disposed a crown suspension and a head suspension, said crown suspension having a central portion adapted to contact the top of a wearer's head and having radially outwardly extending legs, said head suspension including an outer strap which encircles the wearer's head at approximately the level with respect to the wearer's head of a normal hat band, means for attaching at least one of said legs and at least a portion of said strap to the inside wall comprising: a first barb which is joined to said leg and which tapers in thickness from its juncture with the leg to its end; a second barb which is joined to said strap portion at its upper edge and which tapers in thickness from its juncture with the strap to its end; and a suspension engaging means formed on the inside wall of the helmet within which said first barb and said strap portion are accommodated, said member having a slot through which said leg and said strap extend and above which said second barb is positioned, said slot having a width less than the sum of the thicknesses of said first and second barbs at their junctures with the leg and strap respectively whereby removal of said barbs through said slot is prevented.

* * * * *